United States Patent [19]

Nadir

[11] 4,074,253

[45] Feb. 14, 1978

[54] NOVEL BISTABLE LIGHT MODULATORS AND DISPLAY ELEMENT AND ARRAYS THEREFROM

[75] Inventor: Mark T. Nadir, Warren, N.J.

[73] Assignee: Kenneth E. Macklin, White Plains, N.Y.

[21] Appl. No.: 633,494

[22] Filed: Nov. 19, 1975

[51] Int. Cl.[2] ..... G09F 9/32

[52] U.S. Cl. ..... 340/324 M; 340/336; 340/378 R; 350/355

[58] Field of Search ..... 350/161; 340/324 R, 340/324 M, 336, 378 R

[56] References Cited

U.S. PATENT DOCUMENTS

| | | | |
|---|---|---|---|
| 2,281,280 | 4/1942 | Gabor | 350/161 |
| 3,091,876 | 6/1963 | Cole | 340/324 M |
| 3,158,430 | 11/1964 | McNaney | 350/161 |
| 3,168,659 | 2/1965 | Bayre et al. | 350/161 |
| 3,363,347 | 1/1968 | Benson | 340/336 |
| 3,667,830 | 6/1972 | Rottmiller | 350/161 |

*Primary Examiner*—Marshall M. Curtis
*Attorney, Agent, or Firm*—Kenneth E. Macklin

[57] ABSTRACT

A novel bistable light modulator, particularly useful as a visual display element. An array of bistable visual display elements arranged in closely spaced relation. The array preferably comprises the bistable display elements in rows and columns, i.e., a grid or matrix. Each such element can be made to assume one of two stable states by applying appropriate momentary signals to the elements. The elements appear dark in one state and bright in the other state. Appropriate motivating signals may be either electronic, electrostatic, fluidic, pneumatic, mechanical, sonic, magnetic, electromagnetic, piezoelectric, heat, etc. For example, electrical signals may be applied to the rows and columns of the array, which result in each element being selectable to assume either one of the bistable states. Thus each element in turn can be forced into the desired state.

11 Claims, 10 Drawing Figures

NOVEL BISTABLE LIGHT MODULATORS AND DISPLAY ELEMENT AND ARRAYS THEREFROM

BACKGROUND OF THE INVENTION

Light modulators of many kinds are presently in use. Many require expensive equipment to activate, such as cathode ray tube devices, motors, etc. Some modulators are comprised of a deflectable membrane, which is only momentarily deformed when energized.

Visual displays of many kinds are presently in use. One of the most common forms of visual presentation uses the cathode ray tube as the means of presenting data. Various forms of this device are in general use. Another device is the electroluminescent panel. This device is finding increasing usage, but all the faults and deficiencies of the system have not been corrected. Arrays of lamps, light generating diodes, liquid crystal displays and other devices have been developed and are in use.

In the present state of the art the devices for presenting data require a continuous supply of energy to operate properly. The image on the screen of the cathode ray tube will disappear unless "refreshed" periodically. The information for the refresh must be supplied by some device which can "remember" the data, such as core storage, magnetic discs and tapes. This results in complex and costly equipment.

"Nixie" tubes, light emitting diodes, etc. are used for "character" displays. Their use has generally been limited by the need of having expensive electronic ancillary devices (with internal transistorized storage) to activate these elements. In addition many of the devices have a display of low intensity and therefore limited visibility.

SUMMARY OF THE INVENTION

It is an objective of this invention to provide a bistable light modulator, useful among other things as a shutter or display element.

It is an objective of the present invention to provide a simple means for presenting two level data visually.

It is another objective of this invention to generally utilize ambient illumination, which will result in a reduction of power required to operate the display.

It is another objective of this invention to provide a display which requires power only to change an element from one state to another.

It is another objective of this invention to provide a display array which requires only one character generator, which may operate on each display element sequentially.

It is another objective to provide elements and arrays thereof which can be seen in any light.

It is still another objective of this invention to provide a modulator display element which will retain the information last presented to it indefinitely without continuous force or energy being supplied to it.

It is another objective to provide a system which can be made in any desired size.

It is another objective of this invention to provide a system which can be made so thin that it can be mounted on the face of an instrument or hung on a wall.

Generally, the bistable light modulator of this invention is comprised of:

(a) a curved flexible membrane which is adapted to assume only either a concave or convex configuration and which preferably has a light reflective surface or a light reflective coating thereon, (b) a means which in conjunction with (a) results in only two stable visual states, which two states can be differentiated by the viewer. For example, the concave configuration presented to the viewer can appear bright because it concentrates and reflects the light and the convex configuration may appear dark or not so bright because it disperses of diffuses the light.

Generally, one preferred form of the bistable display element of this invention is comprised of:

(a) a curved flexible membrane which is adapted to assume either a concave or convex configuration and which has a light reflective surface or a light reflective coating thereon, (b) something, either a representation or a light, at the focus of the concave configuration, the image of which is reflected in substantially all of the reflective surface of the concave configuration, the reflection in which surface can be seen by a viewer when the membrane is in the concave configuration, and (c) a surround means at the perimeter of the concave - convex configuration of the flexible membrane, the reflection of which surround means can be seen by the viewer when the surround means is illuminated, usually by ambient light, and the membrane is in the convex configuration. The representation or light in (b) and the surround means in (c) are such that there is sufficient contrast between the reflections in (b) and (c) so that the two states can be differentiated by the viewer. For example, if one used a white representation or light in (b), then one could use a black or red surround means in (c).

The membranes of the bistable elements in this system may be either films or discs which have been pressed to become segments of a sphere or an ellipsoid, or films or sheets which have been bent to become longitudinal segments of a cylinder. These membranes for the elements may be made of any flexible material, such as thin sheets of metal, plastic or glass, and can be flexed in use millions of times without failure because of their thinness. Such curved segments can only assume either a convex or concave shape and are therefore bistable.

At least one surface of the membranes of these bistable elements should have some degree of light reflectivity, generally the more the better. If the membranes do not, then they should be silvered or otherwise given a reflective surface. As will be seen, such reflective curve membranes form optical mirrors which can form either a real or a virtual image, depending upon whether the mirror is concave or convex, respectively.

When very small elements are used it may not be necessary to provide a reflective coating, because it will be found that in one state the element interferes with light and in the other state reinforces it.

When a black dot is at the focus of a concave spherical disc or a black line is at the focus of an ellipsoid disc or a cylinder, the disc or cylinder will look dark when observed (over a wide angle) from the front. However, when the disc or cylinder is convex, it will reflect a lighter colored, contrasting area in front and surrounding its perimeter and therefore appear bright (over a wide viewing angle), if it is located in a bright area. By locating each element in a surrounding which is well illuminated by the ambient light, the elements can be made to appear bright when convex.

These bistable elements can be made to change state, for example, by focusing a beam of intense light, not necessarily visible, on each one in turn. A sharply defined beam of any sort, such as sonic energy, can be used for this purpose. The intense energy can be converted into heat by a heat absorber in a closed chamber behind the bistable element. The heat absorber transfers its heat to the air in the chamber behind the bistable element. The pressure caused by the heated air forces the bistable elements to assume one of the two stable states. A flow of air can force the elements, in mass, to the other bistable state to "clear" the picture.

Piezoelectric elements can also be used to operate the bistable elements.

FIGS. *7a* and *7b* are cross sectional views of the concave and convex configurations of a simple bistable light modulator or display element of the invention.

FIGS. *8a* and *8b* are cross sectional views of the concave and convex configurations of a novel bistable element of this invention used as a light modulator or shutter, as for example, in a still camera or motion picture camera.

DESCRIPTION OF THE PREFERRED EMBODIMENTS

Figure 1:
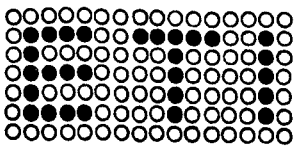
FIG. 1 shows the elements arranged in an array capable of displaying information.

An array of bistable elements arranged in rows and columns is shown in FIG. 1. Some of these elements can be made to appear dark and some can be made to appear bright. Such an arrangement can be made to display characters or other data as is shown by the letters "ETI" shown in FIG. 1.

Figure 2:
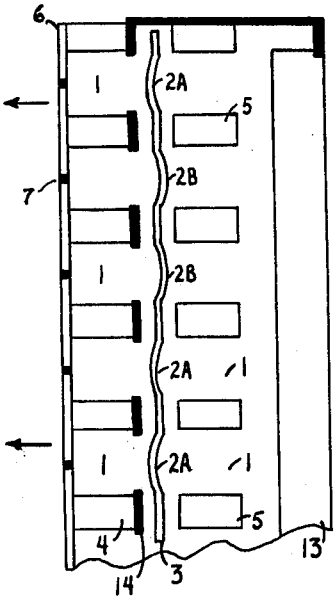
FIG. 2 is a cross sectional view of the structure. The various component parts are shown. A complete description is given later.

A cross sectional area of one of the arrays which includes several of the bistable elements 2 is shown in FIG. 2.

Figure 3:
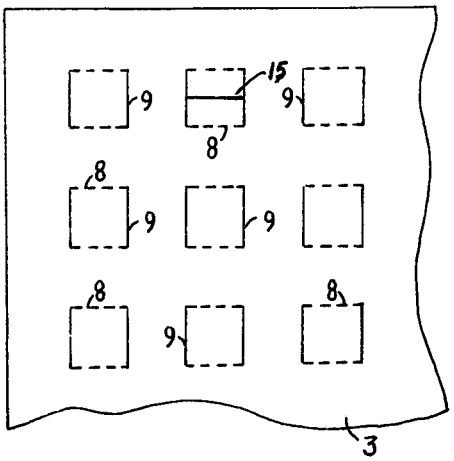
FIG. 3 shows a section of the thin member employing cylindrical bistable elements.

A thin sheet of material 3 is embossed with bistable mirror lens elements 2, i.e., the material is shaped into a segment of a sphere or ellipsoid or a longitudinal section of a cylinder. In the latter case the material may have to be cut, as shown in FIG. 3, to permit the material to move freely. The bending edges of the cylindrical surface 8 are shown as are the cut edges 9 of that surface. The sheet of material may be of almost any convenient substance. This sheet must be thin enough to permit the mirror lens to become either concave or convex without the undue application of force, and yet stiff enough to remain in either concave or convex configuration. Thin metal, glass, and plastic sheets are a good choice.

The cross section of FIG. 2 is normally observed from the front. The arrows indicate the path the light will take to reach the eyes of the observers. The embossed sheet 3 is placed between two thicker sheets of materials 4 and 5. Holes 1 in these sheets coincide with the mirror lens elements 2 in the thin sheet 3 so that the bistable elements are free to move. The bistable mirror lens elements 2 are silvered to reflect light.

The bistable mirror lens element 2A is convex with respect to an observer who is in front of the structure. The observer will see either the area in front of the structure or the edge of hole 1 in sheet 4. If the curvature of the mirror lens element 2A is reasonably large and the sheet 4 is of milky or opal material, then the hole will appear to be bright, assuming the face of the structure is well illuminated.

The material of sheet 4 may be of such thickness that it is equal to the focal length of the bistable element 2B, which is in the concave configuration. In that case a black dot 7 in a clear material 6 placed over the center of the holes 1 will be imaged by the concave mirror lens 2B. The observer in front of the structure will see the block dot imaged in the mirror lens and the mirror lens will appear dark.

In the event that the cylindrical mirror lens is employed, the holes 1 will be rectangular; and instead of the black dots, 7 will be dark lines parallel to the axis of the cylinder, as is shown in FIG. 3.

In the event that an ellipsoidal mirror lens is employed, the holes 1 will be elliptical; and instead of the black dots, 7 will be dark lines parallel to the major axis of the ellipsoid.

The clear material 6 is, of course, a place where the black dot or line 7 can be placed at the focal point of the concave configuration of the bistable element, and may also be required to protect the structure from damage and to prevent air currents from changing the states of the bistable elements 2.

The structure as described is capable of displaying characters, symbols, maps, etc. Means must be provided to permit the data displayed to change as and when required.

Figure 4:
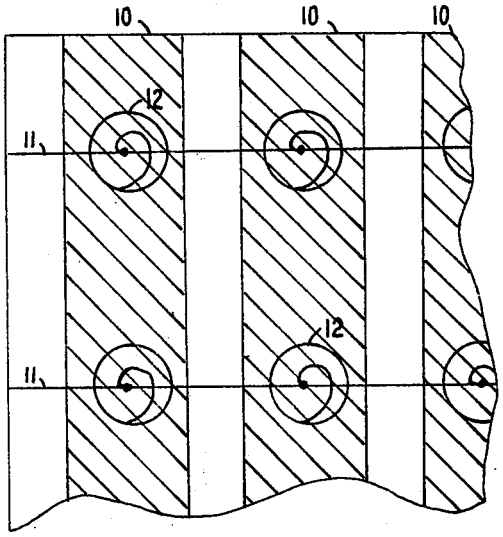
FIGS. 4 and 5 show the means whereby electrical signals may be applied to spherical or cylindrical elements, respectively.

In FIG. 4 each column of bistable elements 2 is silvered so that light is reflected and so that a current can be carried by the silvering 10 This silvering is best on the face side of the bistable elements 2.

The backs of the bistable elements 2 have metal spirals 12. The center of each spiral is connected to the silvered strip 10 as shown. The edges of all the spirals in one row are connected together and brought out to a contact 11 as shown.

Behind the structure a magnet 13, as shown in FIG. 2, is located to provide a magnetic field to be worked against. A sheet of iron 14 with holes punched to coincide with the holes in the front sheet 4 may be placed between the sheet 4 and the embossed sheet 3. The metal may have to be insulated by a lacquer to prevent short circuits. The iron sheet is helpful in completing the magnetic path.

When a voltage is applied to a contact 11 and to one of the silvered strips 10 a current will flow through one of the spirals. The magnetic field generated by the current in the spiral will react on the static field and can force the bistable element from one state to the other. The direction of motion of the bistable element is determined by the direction of current flow.

By selecting rows and columns any element in the array can be caused to change state by a current. The technique of applying currents to this form of matrix is well known in the electronics art.

There are many variations on the basic approach to driving the matrix by electrical signals. For example, a coil may be placed in each hole and connected in a matrix as described. If the back of each bistable element is coated with a magnetic material, the field induced by the coil will cause the element to move against the static field.

Figure 5:
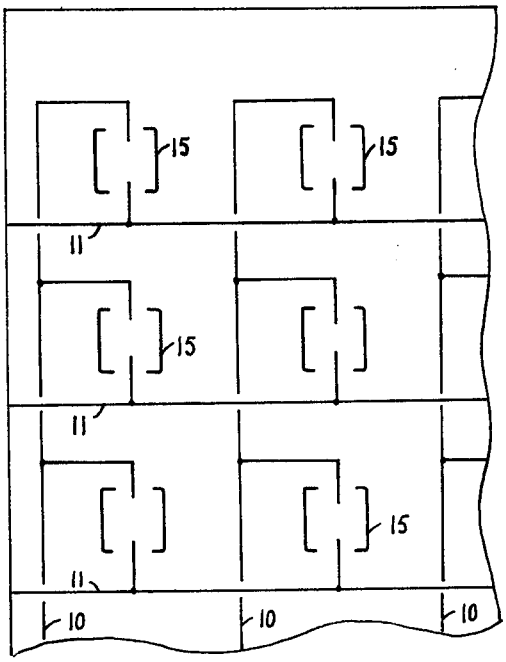

FIG. 5 shows another variation of this technique. the contacts 11 are connected to all bistable elements of the row while the other side of the bistable elements 15 to a row are connected to a common contact 10. The bistable element 15 is a section of a cylinder and is coated with a conductive silvered surface. Current is supplied to a contact from a row and a column as shown.

The magnetic field exists as described before. A large pulse of current can react on the static field and drive the element 15 from one stable state to the other.

Figure 6:
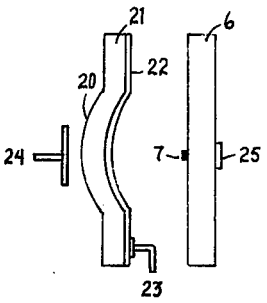
FIG. 6 is a cross sectional view of a single element with electrostatic means for driving it from one state to the other, and also illustrates an element which utilizes electroluminescence to aid visibility.
Figure 7A:
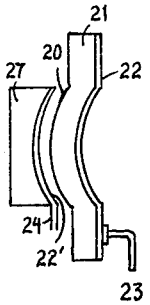
Figure 7B:
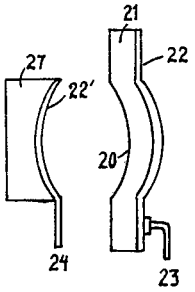
Figure 8A:
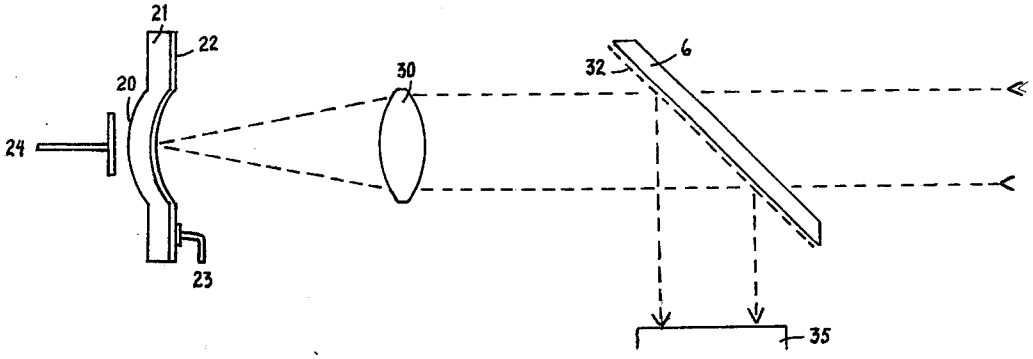
Figure 8B:
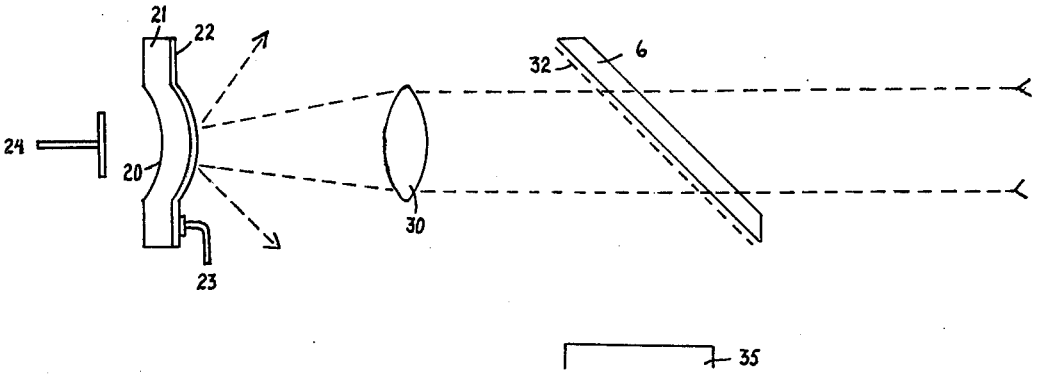

FIG. 6 is a cross sectional view of a single thin display element 20 embossed from a thicker piece of material 21, e.g., suitable plastic. On the viewing side of the element there is an aluminized or silver coating 22, for example. An electrical contact 23 is made to that coating, and another electrical lead 24 is positioned at the rear of the element. Depending on whether the polarities of the contact and lead are the same or opposite, the element will be caused to assume its convex or concave configuration, respectively. A clear sheet 6 has a red dot or line 7 (depending on the shape of the membrane) on one surface at the focus of the concave configuration of the membrane, which dot or line is on the side of the clear sheet toward the flexible membrane, and on the other surface of the clear sheet a blue filter 25, again either a dot or line corresponding to the red dot or line and co-extensive therewith in size and placement. When a blue light shines through the filter the reflection of the fluorescent red dot or line will be seen by the viewer.

FIGS. *7a* and *7b* are cross sectional views of the concave and convex configurations of a simple bistable modulator or display element, which is similar to that depicted in and described for FIG. 6. Instead of the clear sheet 6, however, the means for differentiating the two viewing states is 22' a reflective coating (e.g., aluminized or silvered) on a substrate 27. When the bistable element made of a clear or translucent material 28, is in the concave position the bistable element appears bright to the viewer. Brightness may be increased if the bistable element 20 has an optional slightly reflective coating 22 (e.g., 10% reflective), to reinforce the reflection from 22'. In the convex configuration, (FIG. *7a*) the bistable element would either appear dark or not as bright because the ambient light would not reach 22' in any great degree, and any light which did reach 22' would either be reflected back by 20, and especially if optional partially reflective coating 22 were present. In addition, the convex configuration would also tend to disperse and diffuse incident and transmitted light.

FIGS. *8a* and *8b* are cross sectional views of the concave and convex configurations of a bistable element of the invention used as a light modulator or shutter. The bistable element is similar to that depicted in and described above for FIG. 6. When the bistable element is in its concave configuration, light coming from the right passes through clear material 6 having a partially reflective surface 32 (e.g., about 10% mirror coating) to lens 30 which focuses the light on the reflective coating of the bistable element 20. The rays are reflected back through lens 30 and because of the partially reflecting surface 32, they are reflected downward to some degree because of the angle of the surface 32. The downward rays can be made to strike photographic film 35 at that point, thereby exposing it and forming a latent image corresponding to the pattern of the originally incident light.

In the convex configuration (FIG. *8b*), surface 22 disperses the light so no or extremely little light reaches photographic film 35. By means of appropriately placed baffles, one can ensure that no light reaches the film. And by means of appropriate mechanical means to advance the film by frames and by appropriately timed electrical pulses to leads 23 and 24, one can operate the shutter, which is what the bistable element is functioning as, and advance the film in a sophisticated still or movie camera, depending on the mechanisms chosen.

Another useful application for the elements and display arrays of this invention is one that is analogous to the use of "light pens" with cathode ray tube terminals to "write" or "draw" an image on the screen of the tube. In the analogous application with the display arrays of this invention, one could use any sort of stylus from which a relatively narrow beam of energy can be made to emanate. For example, one can use a stylus from which there emanates electrostatic, electromagnetic, magnetic, sonic, or heat energy or a laser beam. Depending on the energy emitted, the elements of the array are constructed so that the energy source could be used to activate either one or both of the stable states of the elements. For example, the foregoing specification indicates some of the construction features which might be used.

Of course, it would also be possible to "read" information displayed by the array by use of some of the same devices. For example, one can use a stylus sensitive to electrostatic charges or magnetic polarity to read. Circuitry between the reading stylus and additional peripheral equipment could be used to transport the information read to whatever peripheral device or computer required it.

The bistable visual display panel of this invention comprised of a number of display elements is a device which can be manufactured in a number of sizes (for example, from $\frac{1}{2} \times 1\frac{1}{2}$ inches to $15 \times 20$ feet) and can be designed for a large variety of uses. The display panel can be a very thin and light-weight device. A medium size panel (about $4 \times 4$ feet) could be about $\frac{3}{4}$ inch thick and could weigh 2 or 3 pounds. Such a panel might be hung on a wall and viewed from several feet away. Large panels would not be much thicker or much heavier in proportion to their size. Small panels could be about an eighth of an inch thick, at most, and could be mounted on instruments with a drop of glue.

Large display panels can be used for displaying text, numbers, figures, symbols, animated cartoons, etc. These can be used wherever large displays are needed, such as government installations, billboards, stock display panels, train and airline terminals, etc. Medium size display panels have application in offices and showrooms to display computer and sales data. Medium size units can be mounted on the surfaces of desks (under glass) or hung on walls as well as mounted on equipment.

Any form of two level information (i.e., black and white) can be displayed, such as letters, numbers, symbols, graphs, maps, etc. Data can be stationary or animated.

Because of the simplicity and ease of construction, these units can be made in small sizes very inexpensively. This low cost comes about because plastics can be used as the materials, and because the assembly can be carried out by automatic machinery. The expected yield is high, i.e., very close to 100%.

For example, the main member of the assembly can be a thin sheet of plastic. This sheet can be embossed with a large number of mirror lenses, by any one of several techniques. The sheet of plastic is then enclosed in a grill which in turn is covered by a sheet of stiff plastic. A thin magnet can be enclosed in the case.

The thin sheet of plastic can be machined, by printed circuit techniques, to produce electrodes which will cause the elements to operate upon command. This simple basic procedure is capable of producing a large number of reliable display panels inexpensively and without the need for highly skilled personnel.

These units are inexpensive to use, relative to other known devices. Since there is a built-in drive for the display, only a pair of transistors (or equal) is required to generate the display.

Once display formation has been generated, it may remain in view indefinitely. No power is required to view the display since viewing is achieved with the aid of ambient light. A display once generated stays in view without need for "refresh" or "updating" (which are techniques presently used by the majority of displays). Old data can be removed as new data is added automatically.

The display panel can be activated by a large number of means: electrical, electromagnetic, electrostatic, sonic, pneumatic, laser beam, etc. This increases the already large number of fields of usefulness still further.

The response times of the elements of the display panel are fast enough to be compared with all electronic display devices, and they are very fast as compared with known mechanical display devices. The display panel can be used in almost every case where a visual display is required and an electronic device is not being used.

What is claimed is:

1. A bistable light modulator which comprises:

(a) a curved flexible membrane which is adapted to assume only either a stable concave or stable convex configuration and (b) optical means positioned in accordance with one of the two stable states for enhancing the visibility of one of the two stable states.

2. A bistable display element as claimed in claim 1, which is comprised of:

(a) said curved flexible membrane adapted to assume either a stable concave or stable convex configuration having a light reflective surface or a light reflective coating thereon, (b) said optical means comprising (i) a line or a point at the focus of the concave configuration, the image of which is reflected in substantially all of the reflective surface of the concave configuration, the reflection in which surface can be seen by a viewer when the membrane is in the concave configuration, and (ii) a light reflective surround means at the perimeter of the concave - convex configuration of the flexible membrane, which surround means is sufficiently contrasted to the image in (b) that its image can be seen by the viewer when the surround means is illuminated and the membrane is in the convex configuration as a different visual state from that in which the element is in the concave configuration.

3. A bistable display element as claimed in claim 2, which also comprises:

(d) a means for changing the curved flexible membrane from its concave to convex configuration or vice versa.

4. A bistable element as claimed in claim 3 wherein the means for causing the curved flexible membrane to change from its concave to convex configuration or vice versa is magnetic, electromagnetic, piezoelectric, or electrostatic.

5. A bistable display element as claimed in claim 2 wherein the concave or convex configuration is a segment of a sphere and there is a dot at the focus of the concave configuration.

6. A bistable display element as claimed in claim 2 wherein the concave or convex configuration is a longitudinal section of a cylinder and there is a line at the focus of the concave configuration.

7. A bistable display element as claimed in claim 2 wherein the concave or convex configuration is a segment of an ellipsoid and there is a line at the focus of the concave configuration.

8. An array of at least two bistable display elements as claimed in claim 2 comprised of:

(a) said curved flexible membrane adapted to assume either a stable concave or stable convex configuration having a light reflective surface or a light reflective coating thereon, (b) said optical means comprising (i) a line or a point at the focus of the concave configuration, the image of which is reflected in substantially all of the reflective surface of the concave configuration, the reflection in which surface can be seen by the viewer when the membrane is in the concave configuration, and (ii) a light reflective surround means at the perimeter of the concave - convex configuration of the flexible membrane, which surround means is sufficiently contrasted to the image in (i) that its image would be seen by the viewer when the surround means is illuminated and the membrane is in the convex configuration as a different visual state from that in which the element is in the concave confuiguration.

9. An array of at least two bistable display elements as claimed in claim 8 which also comprises:

(d) a means for changing the curved flexible membranes from their concave to convex configurations or vice versa.

10. An array of at least two bistable display elements as claimed in claim 9 wherein the means for causing the curved flexible membrane to assume either its stable concave or stable convex configuration is magnetic, electromagnetic, piezoelectric, or electrostatic.

11. An array of at least two bistable display elements as claimed in claim 9 wherein the means for causing the curved flexible membranes of the elements to change from their concave to their convex configuration or vice versa is made available to the individual elements in a matrix arrangement, thereby establishing the capability of causing selected individual elements to change membrane configuration from concave to convex and vice versa and the resultant capability of causing the selected element to assume one of its two stable viewing states.

* * * * *